United States Patent [19]

Swan

[11] Patent Number: 4,534,089

[45] Date of Patent: Aug. 13, 1985

[54] FASTENING DEVICE FOR FLEXIBLE SHEETS

[76] Inventor: Thomas C. Swan, P.O. Box 389, Dawsonville, Ga. 30534

[21] Appl. No.: 483,166

[22] Filed: Apr. 8, 1983

[51] Int. Cl.[3] ..... B42F 1/00

[52] U.S. Cl. ..... 24/559; 24/30.5 P

[58] Field of Search ..... 24/16 R, 16 PB, 17 AP, 24/30.5 P, 19, 20 TT, 67.9, 484, 470, 472, 519, 520, 530, 542, 543, 545, 546, 559, 563, 578, 580, 630, 697

[56] References Cited

U.S. PATENT DOCUMENTS

| | | | |
|---|---|---|---|
| 851,414 | 4/1907 | Goodnough | 24/457 |
| 2,567,298 | 9/1951 | Morner et al. | 24/697 X |
| 3,141,221 | 7/1964 | Faulls . | |
| 3,180,384 | 4/1965 | Seifert . | |
| 3,217,690 | 11/1965 | Mihalisin | 24/67.9 X |
| 3,371,702 | 3/1968 | Keegan et al. . | |
| 3,422,504 | 1/1969 | Brown . | |
| 3,467,999 | 9/1969 | Bjorksten et al. . | |
| 3,530,550 | 9/1970 | White . | |
| 3,571,861 | 3/1971 | Olson | 24/30.5 P |
| 3,654,049 | 4/1972 | Ausuit | 24/16 PB |
| 3,729,045 | 4/1973 | MacDonald . | |
| 3,729,780 | 5/1973 | White . | |
| 3,854,482 | 12/1974 | Laugherty et al. | 24/543 X |
| 3,913,186 | 10/1975 | Ray et al. . | |
| 3,982,307 | 9/1976 | Smith et al. | 24/543 |
| 3,987,835 | 10/1976 | Bloomfield . | |
| 3,991,806 | 11/1976 | Abell . | |
| 4,107,826 | 8/1978 | Tydsal . | |
| 4,170,810 | 10/1979 | Peleg . | |
| 4,191,361 | 3/1980 | Jensen . | |
| 4,194,274 | 3/1980 | Garrison | 24/543 X |
| 4,220,301 | 9/1980 | Jacobs et al. | 24/16 PB X |

FOREIGN PATENT DOCUMENTS

| | | | |
|---|---|---|---|
| 1166558 | 3/1964 | Fed. Rep. of Germany | 24/559 |
| 1286849 | 1/1962 | France . | |
| 1522441 | 4/1968 | France | 24/559 |
| 898124 | 6/1962 | United Kingdom | 24/16 PB |

*Primary Examiner*—William E. Lyddane
*Assistant Examiner*—James R. Brittain
*Attorney, Agent, or Firm*—Newton, Hopkins & Ormsby

[57] ABSTRACT

A pair of cooperating resilient clamping heads of a fastener, removeably clamp edge portions of flexible sheets together, the clamping heads being themselves integrally joined together by a flexible strap. The inner surface of one head is provided with a transverse recess having spaced, opposed, inwardly converging, flanges between which are received the inwardly diverging, opposed surfaces of a locking lug removeably recessed in the recess. The lug and recess have conforming curved linear surfaces which frictionally hold the flexible sheets together. The fasteners are manufactured by extruding a continuous plastic sheet provided with a thin central portion and thicker side areas. The side areas have curve linear portions for forming the conforming recess and locking lug areas. The extruded sheet is cut at transversely spaced portions to provide the fasteners.

7 Claims, 10 Drawing Figures

FASTENING DEVICE FOR FLEXIBLE SHEETS

BACKGROUND OF THE INVENTION

1. Field of the Invention

This invention relates to a fastening assembly and is more particularly concerned with a fastening device for removeably holding one or a plurality of flexible sheets.

2. Description of the Prior Art

In the past, tents have usually been held down by lengths or rope passed through grommets in the edge portions of the fabric and secured to stakes appropriately driven into the ground. The grommets weaken the fabric and are relatively expensive to provide in the fabric. The prior art tents with grommets usually require that the stakes be evenly spread apart and that the ropes be drawn taut around the stakes.

When plastic film or sheets are to be joined together, usually either glue or heat and pressure is employed for permanently joining the sheets together. Holes are not normally placed in such plastic sheets or films easily tear, once a cut or tear is started.

The present invention solves the above problems by providing an inexpensve fastener which has resilient clamping heads having relatively large conforming areas which quite firmly frictionally hold one or a plurality of flexible web, sheets, film or fabric, without puncturing or destroying the material clamped.

SUMMARY OF THE INVENTION

Briefly described, the present invention includes a unitary or integral (one piece) plastic fastener, formed from a cross section or profile extruded as a plastic single sheet. The profile has a thin flexible central web and a pair of spaced opposed larger side portions joined by the web.

One of the side portions has an upper surface provided with a sidewise opening recess defined by a pair of spaced, opposed, converging flanges, the inner surfaces of which are convex and generally semi cylindrical with inner edges which merge at a central lobe.

The other side portion has, along its upper surface, a locking lug area, the surface of which forms outwardly diverging lobes with central valleys therebetween.

Transversely cut lengths of the extruded profile, form the fasteners of the present invention, the contour of the locking lug conforming to the contour of the recess so as to be removeably received, therein.

When the fastener is used, the two clamping heads, formed from the sides of the extruded profile, are brought into opposition with each other whereby the locking lug of one head is opposite to the valley of the other head and the strap, formed from a portion of the web of the profile, is looped to U-shape to provide a bight which is suitable for receiving a rope. The flexible sheet or sheets of material are disposed between the two heads and the two heads are forced together.

Accordingly, it is an object of the present invention to provide a fastener for web, sheet, film or fabric material which fastener is inexpensive to manufacture, durable in structure and efficient in operation.

Another object of the present invention is to provide a fastener which can be produced from a plastic extrusion.

Another object of the present invention is to provide a fastener which is capable of clamping sheet material and will not readily open when pulled along the plane of the sheet material.

Another object of the present invention is to provide a fastener for sheet material which will not appreciably distort, destroy or injure the sheet material.

Another object of the present invention is to provide a fastener which can be readily and easily clamped and unclamped.

Another object of the present invention is to provide a fastener which is reuseable, is of one piece construction, is light weight and can readily and easily receive a rope or line.

Another object of the present invention is to provide a fastener which is quite simple to manipulate and can be clamped and unclamped in poorly lit areas by feeling the condition of the clamp.

Another object of the present invention is to provide a fastener which can be joined together so as to clamp two sheet edge portions together.

Another object of the present invention is to provide a fastener which can be substituted for grommets in a tent or tarpaulin and can be used for joining sheet material such as the tent edge and fabric floor, together.

Another object of the present invention is to provide a fastener which can clamp and hold open the end of a plastic bag and is particularly useful for holding the edges of a plastic liner in a garbage can.

Other objects, features and advantages of the present invention will become apparent from the following description when taken in conjunction with the drawings wherein like characters of reference denote corresponding parts throughout the several views.

DETAILED DESCRIPTION OF THE PREFERRED EMBODIMENTS

Figure 1:
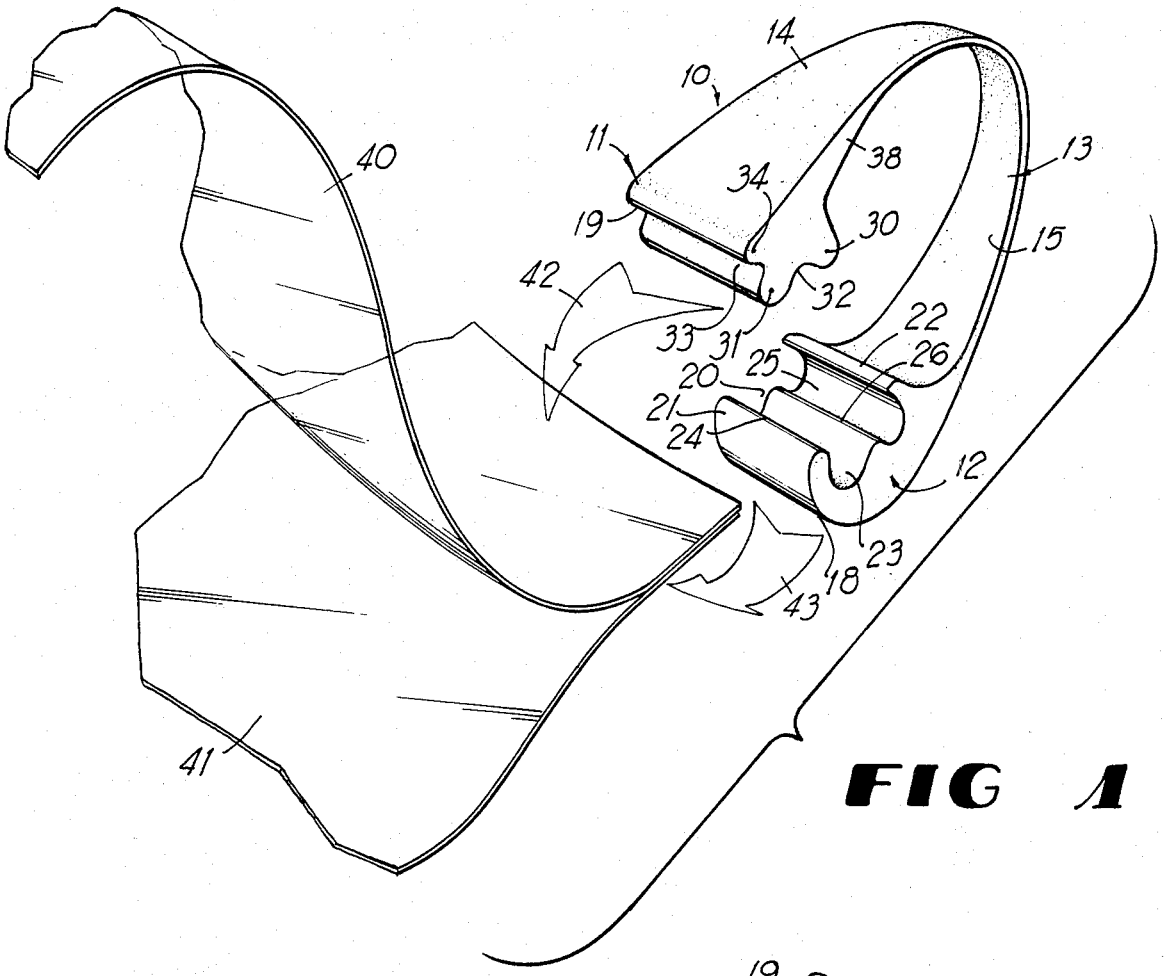
FIG. 1 is a fragmentary perspective view of a fastener constructed in accordance with the present invention and being applied for joining contiguous edge portions of sheet material.

Referring now in detail to the embodiments chosen for the purpose of illustrating the present invention, numeral 10, in FIGS. 1 through 6, denotes generally the plastic, flexible, resilient, unitary, i.e., one piece, fastener, having a pair of clamping heads, denoted generally by numerals 11 and 12, the heads 11 and 12 being integrally joined by a flexible strap or bale 13. The fastener 10 is a cross sectional portion of an extruded plastic profile, having a relatively thin central web from which the strap 13 is formed and a pair of relatively thicker sides from which the clamping heads 11 and 12 are formed. Thus, the fastener 10 has uniform transverse dimensions, defined by the extrusion die (not shown).

In more detail, the fastener 10, when in its initial extruded condition, has a flat bottom or outer surface 14 throughout substantially its entire length (transverse of the extrusion profile) and an upper or inner flat central surface 15 parallel to surface 14 to define the thin flexible strap or bale 13. The edges of surface 15 curve upwardly, at numerals 16 and 17, so as to define the inner extremeties of the relatively thick heads 11 and 12. The edges of outer surface 14 merge with a convex edge surface 18 of head 12 and a smaller convex edge surface 19 of head 11. In a folded position of the fastener 10, as illustrated in FIGS. 1 through 6, the head 11 is the upper lug carrying head and head 12 is the cavity defining lower head. Head 12 has a lug receiving inwardly opening recess 20, defined by a pair of spaced, opposed, slightly converging, distal and proximal inwardly extending flanges 21 and 22. The distal flange 21, is defined by a portion of the convex edge surface 18 and a portion of the inner concave, surface 23 which is spaced inwardly of and generally concentric with the portion of edge surface 18. The free edges of surfaces 18 and 23 are joined by a convex surface 24 which forms the low lip of the fastener 10.

The inner flange 22 of head 12 has an inner, valley defining, surface 25 inwardly surface 23. The adjacent edge portions of surface 25 and surface 23 converge in an upward taper to define the upwardly tapered transverse central lobe 26 which protrudes into recess 20.

The upper head 11 forms the lug supporting head and has a downwardly extending lug consisting of a pair of transversely extending, downwardly diverging, semicylindrical, locking lobes 30 and 31, shaped to conform to and be received in the transverse recess 20, whereby the front lobe 31 conforms to and is received in the front cavity defined by surface 23 and the rear lobe 30 conforms to and is received in the rear cavity of surface 25.

The concaved valley 32, between the lobes 30 and 31 conforms to and is received over the ridge 26, when the lobes 30 and 31 are seated in their cavities.

Protruding forwardly from the upper outer corner of the head 11 is a front flange or lip forming lobe 34 having a transverse valley 33 between the lobe or flange 34 and the lobe 31.

Since the fastener 10 is an extrusion, the dimensions transversely of fastener 10 are uniform, whereby the lobes 30, 31 and cavities formed by surfaces 23 and 25 respectively have uniform contours from one side to the other. The valley 33 and the bottom surface of the guide lobe 34 cooperate with the upper edge 24 of the front flange 21 so as to position the locking lug in position for it to be pivoted clockwise by manual pressure into its locked position.

Figure 6:
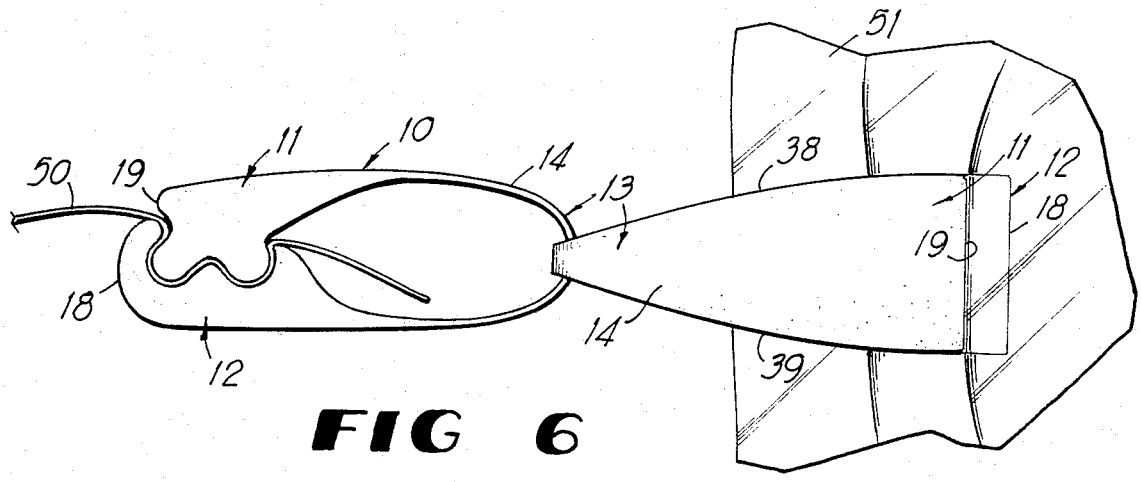
FIG. 6 is a side elevational view of two fasteners constructed in accordance with the present invention and joined together for clamping two edge portions of sheets together.

The fastener 10 is preferably shaped to provide vertically disposed sides 38 and 39 which, as best seen in FIG. 6 taper rearwardly so that the central portion of the strap 13 is relatively narrow with respect to the wider heads 11 and 12.

In FIGS. 1–5, the progressive locking of the fastener 10 is illustrated, the fastener 10 locking the edge portions of flexible plastic or fabric web, sheets or film material 40 and 41, together with the material 40 and 41 protruding laterally from both sides.

Figure 2:
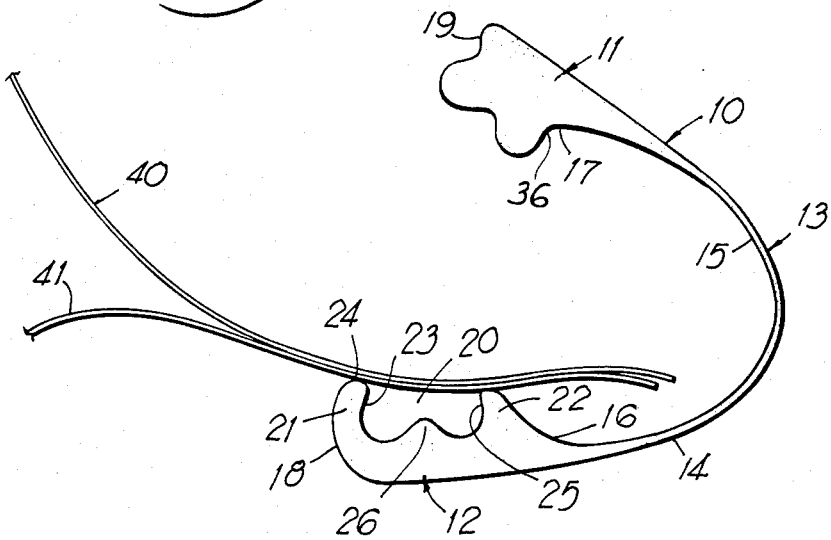
FIG. 2 is a side elevational view of the fastener and sheet material of FIG. 1.
Figure 3:
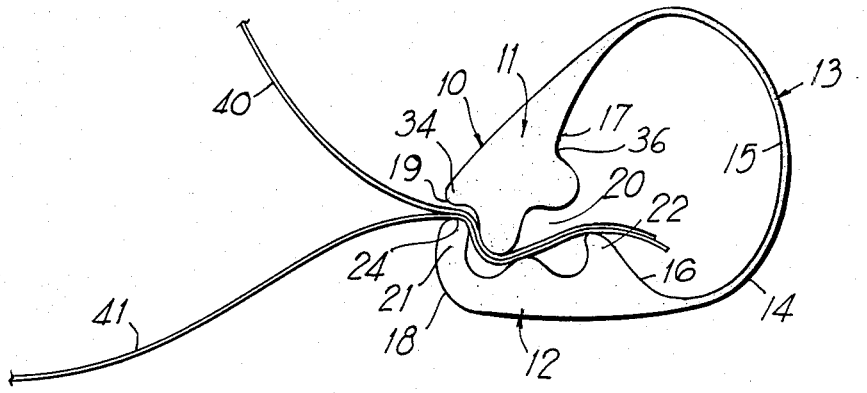
FIGS 3, 4 and 5 are views similar to FIG. 2 and showing the fastener of the present invention being progressively closed on the sheet material.

In FIG. 1, it is seen that when the fastener 10 is to be utilized, the top head 11 is brought over or in a position for registry with the head 12, the head 11 being disposed on one side of the edge portions of the sheet material 40 and 41, which are to be joined together, and the head 12 being disposed on the other side thereof, as illustrated in FIGS. 1 and 2. Then, the heads 11 and 12 are brought together, as illustrated by the arrows 42 and 43 in FIG. 1, the guide lobe 34 being brought toward the lip 24 of the front flange 21, with the two edge portions of sheet material 40 and 41 being disposed therebetween. Thereafter, manual pressure is applied to the heads 11 and 12 so as to pivot, clockwise, the locking lobes 30 and 31 about the fulcrum formed by lip 24 and into their respective cavities of surfaces 25 and 23.

Figure 4:
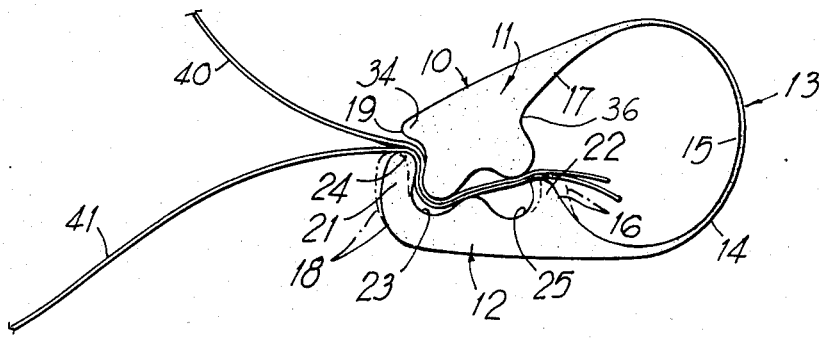
Figure 5:
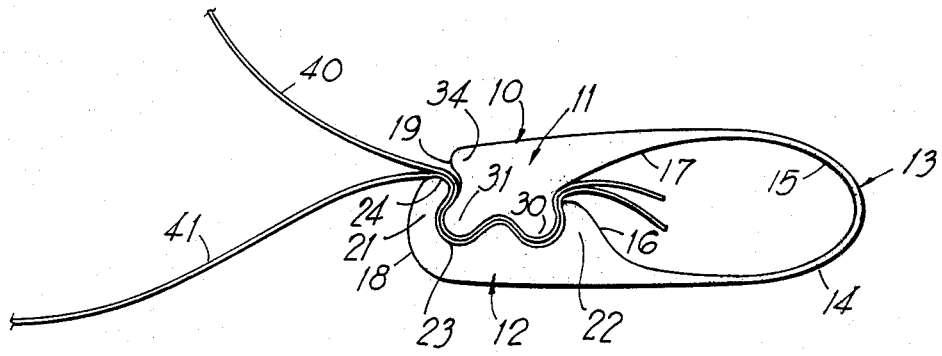

As the top head 11 is urged toward the bottom head 12, the lobe 30 urges the rear flange 22 rearwardly, as shown in broken lines in FIG. 4, while, at the same time, the valley 33 and the front lobe 31 urges the front flange 21 forwardly, as also shown in broken lines in FIG. 4. The fastener 10 is made of a yieldable resilient plastic, such as polypropylene, so that the flanges 21 and 22 are not urged beyond their elastic limits but rather spring back into essentially their original positions, as shown in FIG. 5, the lip 24 protruding into valley 33 and the free edge of rear flange 22 protruding into a rear valley 36 in head 11. The lobes 30 and 31 are thus seated in their respective recesses 23 and 25, thereby clamping sheet material 40 and 41 together, quite firmly but gently so as to not destroy the sheet material 40 and 41. It is preferable that the sheets 40 and 41 be inserted into the fastener 10 sufficiently that their edge portions protrude within the loop or bight formed by the strap 13.

When the lug is fully received in the recess 20, the deformed portions of flanges 21 and 22 return to their nondeformed or less deformed condition. The fastener 10 quite firmly holds the sheet material 40 and 41 together and will normally not be dislodged by any pulling on the sheet material 40 and 41. This is because the rear lobe 30 quite firmly locks the front lobe 31 in place in its cavity of surface 23 and the lobes 30 and 31 will arrest any unseating pressure on the lobe 31, until the rear portion of the head 11 has been pivoted, in a counterclockwise direction so as to move the head 11 from its position shown in FIG. 5 to its position shown in FIG. 4.

Any suitable line, rope or cable (not shown) can be looped through the loop or bight formed by the strap 13 so as to provide a means for holding the fastener 10 in place. Indeed, as shown in FIG. 6, two fasteners 10 may be looped together by means of their straps 13 so that one fastener 10 protrudes in one direction and can clamp a sheet 50 and a second fastener 10 protrudes in the other direction and can clamp a sheet 51 disposed perpendicularly to the sheet 50.

Figure 7:
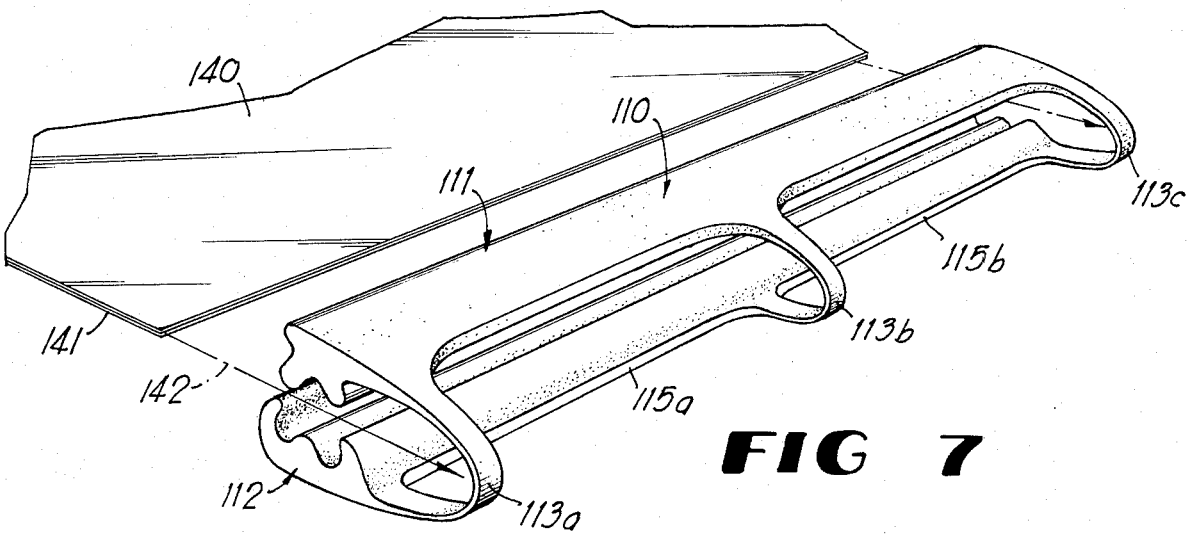
FIG. 7 is a perspective view of a modified form of fastener constructed in accordance with the present invention, the fastener being shown in an open position for receiving the edges of sheet material.
Figure 8:
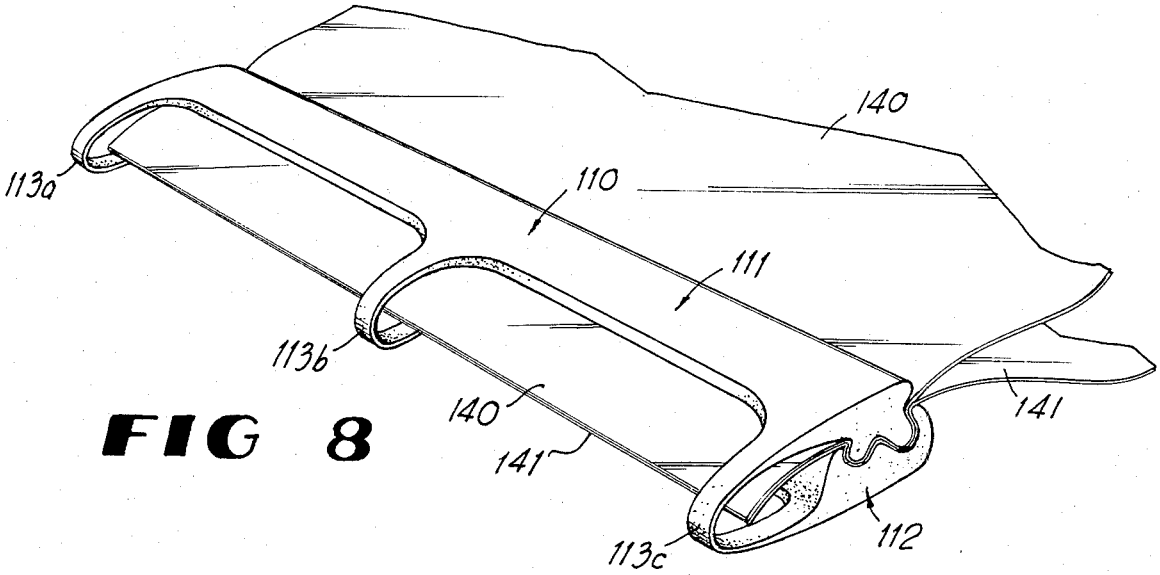
FIG. 8 is a perspective view of the fastener shown in FIG. 7 and closed on the edge portions of the sheet materials.

In the modified form of the present invention as illustrated in FIGS. 7 and 8, it is seen that, if desired, a relatively wide fastener 110 can be produced from the same extrusion as that which produced the fastener 10. In such a structure, the head 111 and the head 112 would have identical contours to that of the heads 11 and 12 of the preceding embodiment. The extrusion for fastener 110, however, is provided with generally rectangular openings **115*a* and 115*b* in succession longitudinally along the central web of the extrusion. Thus, a plurality of transversely spaced straps or bales 113*a***, 113*b* and 113*c* are provided, spaced from each other along the resulting width of the fastener 110.

As shown in FIGS. 7 and 8, a pair of sheets of flexible material, such as sheets of plastic or fabric 140 and 141 are joined together and inserted as indicated by arrow 142 into the space between the head 111 and 112. Thereafter, the head 111 and 112 are moved into registry with each other as explained for the fastener 10. Thus, a relatively wide edge portion of the sheets 140 and 141 are quite uniformly clamped together.

The plastic material from which the fasteners 10 and 110 are produced, have sufficient resiliency that the straps 13, 113*a*, 113*b* and 113*c* will normally urge the heads 11 and 12 and 111 and 112 apart. Therefore, when the rear portion of the heads 11 and 12 and 111 and 112 are pulled apart, the heads 11, 12, 111 and 112 tend to spring apart.

From FIG. 8, it will be seen that any one or a plurality of the straps 113*a*, 113*b* and 113*c* can receive rope, line or other fastening elements which can be used to anchor or secure the fastener 110 in place.

Figure 9:
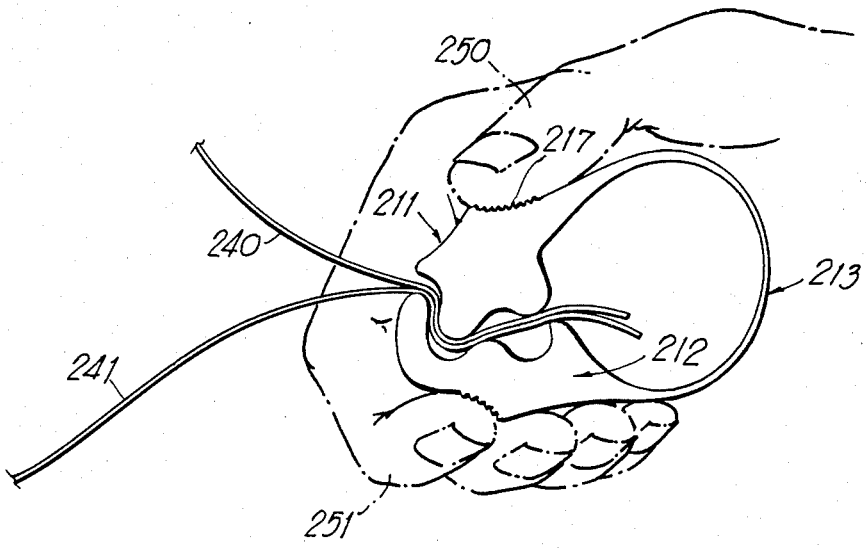
FIG. 9 is a side elevational view of another modified form of the present invention, showing the modified fastener being clamped on sheet material.
Figure 10:
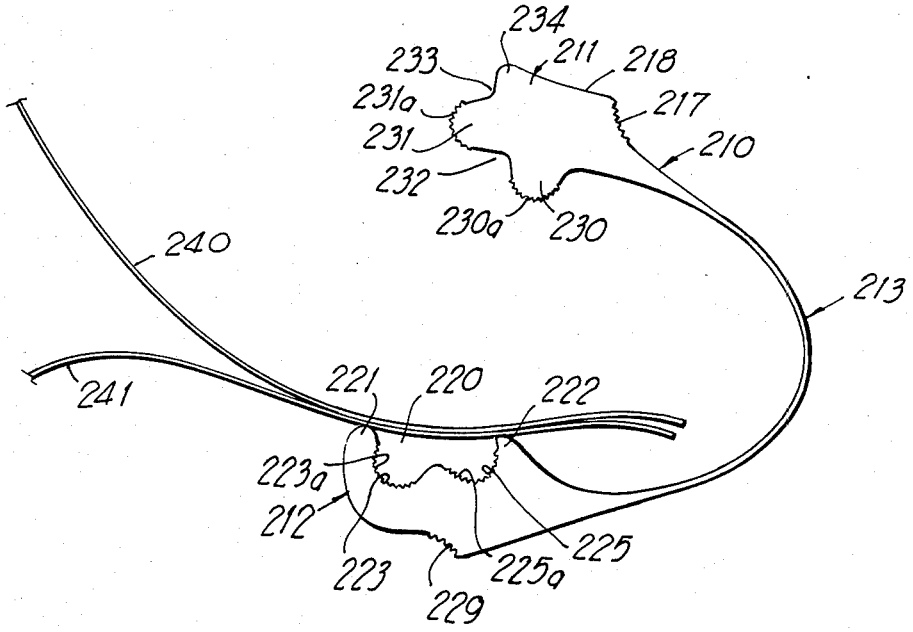
FIG. 10 is a side elevational view of the fastener of FIG. 9 in an open position for receiving the sheet material.

In FIGS. 9 and 10 are illustrated other forms of the present invention. Here, a fastener 210 is illustrated as having a locking lug head 211 and a recess head 212 joined by a strap 213. This structure can also be produced from a cross-section of the extruded material. The locking lug head 211 is an enlarged head which has a pair of diverging locking lobes 230 and 231 respectively provided with transverse serrations or ribs 230*a* and 231*a* as illustrated in FIG. 10. The serrations 230*a* and 231*a* extend along the convex surfaces of the lobes 230 and 231, respectively, the serrations being in the form of alternate valleys and ridges, the ridges tapering outwardly to a rounded outer edge. The embodiment of FIG. 10 has the forward lobe 231 extending essentially in a forward direction while the rear lobe 230 extends essentially in a downward direction, the lobes 230 and 231 defining a valley 232 therebetween. Also, there is a guide lobe 234 which is convex and adjacent to the lobe 231 so as to define a guide valley or recess 233. The guide lobe 234 is at the upper front corner at the head 211 while there is a concave rear area 217 which is provided with serrations, the concaved rear area 217 being in opposition to the front lobe 231. The flat upper surface 218 of the head 211 is opposite to the rear lobe 230*a*.

The head 212 has a recess 220 which conforms generally to the contour of the diverging lobes 230 and 231 and the surfaces 223 and 225 are provided with serrations 223*a* and 225*a* which cooperate with the serrations 231*a* and 230*a* respectively. The lower head 212 is provided with a rear flange 222 and a front flange 221 which are of cross-sectional shape quite similar to the cross-sectional shape of the flanges 22 and 21, respectively. In the embodiment of FIGS. 9 and 10, the head 212 has a front portion which is offset from the remainder of the head so as to provide a concave finger receiving surface 229 which is provided with transverse serrations similar to the serrations of the finger receiving concave surface 217. Thus, a more convenient shape is provided for clamping the heads 211 and 212 together. In FIG. 9, it is shown that the thumb 250 of a person can be placed on the concave portion 217 of head 211 while the index finger 251 can be placed against the serrations of the concaved portion 229 for bringing the head 211 into registry with the head 212 to thereby clamp the sheets 240 and 241 together as illustrated in FIG. 9. The serrations 223*a*, 225*a*, 231*a* and 230*a* function to more firmly grip those portions of sheets 240 and 241 which are disposed between the heads 210 and 211.

It will be obvious to those skilled in the art that many variations may be made in the embodiments here chosen for the purpose of illustrating the present invention, without departing from the scope thereof as defined thereof by the appended claims.

I claim:

1. A fastener for clamping a portion of a flexible sheet, comprising:

(a) a pair of resilient heads for receiving therebetween said portion of said sheet;

(b) one of said heads having along one side thereof a lug with spaced front and rear locking lobes extending transversely of said one of said heads, said lobes extending toward the other of said heads and diverging from each other in the direction in which they extend, said lobes having convex surfaces;

(c) the other of said heads having front and rear flanges extending transversely of said head, said flanges having spaced opposed concave inner surfaces conforming generally to the outer portions of the convex surfaces of said locking lobes;

(d) said other of said heads defining, between said flanges, an inwardly opening recess for receiving between said flanges said portion of said sheet and said locking lobes, with said front flange extending partially around a portion of said front lobe and said rear flange extending partially around a portion of said rear lobe;

(e) one of said heads having a transverse valley between said front and rear lobes and the other of said heads has a central lobe within said recess, said central lobe being between and spaced from said flanges and protuding to a lesser extent than the extent of the flanges into said valley of one of said heads, when said lobes are received in said recess;

(f) said front flange extending sufficiently around the front portion of said front lobe, and said front lobe extending into said recess sufficiently that when said portion of said sheet and both of said lobes are fully within said recess, tension applied forwardly on said sheet will not readily force said lug out of said recess; and (g) said front lobe being confined by said front flange to a greater extent than the rear lobe is confined by said rear flange so that said heads can be urged apart by urging the rear portion of said one of said heads away from the rear portion of the other of said heads as the front portion of one of said heads pivots about the front portion of the other of said heads for releasing said lug from said recess, and said lug cannot be readily removed from the other of said heads by without first removing the said rear lobe from said recess.

2. The fastener defined in claim 1 wherein said recess has uniform dimensions transversely, throughout the length of the recess and wherein said lug conforms generally to the shape of said recess, said lug deforming portions of said other of said heads when installed in said recess.

3. The fastener defined in claim 1 including a narrow resilient strap extending from one side of one of said heads to one side of the other of said heads for joining the two heads together.

4. The fastener defined in claim 1 including a forwardly extending flange on a side of one of said heads, said one of said heads having a valley between said forwardly extending flange and said lug for receiving a portion of the front flange of said other of said heads and for facilitating pivotal movement of said lug out of its locked position in said recess.

5. The fastener defined in claim 1 including a plurality of spaced straps joining one side of one of said heads with one side of the other of said heads, said straps being spaced from each other transversely of the heads.

6. The fastener defined in claim 1, including a plurality of serrations extending transversely of the fastener along the convex surfaces of said lobes and wherein the concave surfaces of said other of said heads are provided with longitudinally extending serrations for increasing the tension on said sheet when said lug is in said recess.

7. The fastener defined in claim 1 including a second identical fastener having resilient straps respectively connecting the heads of each of the fasteners, the straps passing between themselves so that the head of one fastener extends in one direction and the head of the other fastener extends in an opposite direction.

* * * * *